US011191692B2

(12) United States Patent
Aspinal et al.

(10) Patent No.: US 11,191,692 B2
(45) Date of Patent: Dec. 7, 2021

(54) ORTHOPAEDIC APPARATUS FOR TREATMENT OF ARTHROFIBROSIS

(71) Applicants: Sara Kate Aspinal, Leicester (GB); Gerald Cartmel, Leceister (GB)

(72) Inventors: Sara Kate Aspinal, Leicester (GB); Gerald Cartmel, Leceister (GB)

(73) Assignee: Sara Kate Aspinal, Leicester (GB)

( * ) Notice: Subject to any disclaimer, the term of this patent is extended or adjusted under 35 U.S.C. 154(b) by 186 days.

(21) Appl. No.: 16/071,449

(22) PCT Filed: Feb. 2, 2017

(86) PCT No.: PCT/EP2017/052261
§ 371 (c)(1),
(2) Date: Jul. 19, 2018

(87) PCT Pub. No.: WO2017/134169
PCT Pub. Date: Aug. 10, 2017

(65) Prior Publication Data

US 2019/0021930 A1 Jan. 24, 2019

(30) Foreign Application Priority Data

Feb. 3, 2016 (GB) ..... 1600742.9

(51) Int. Cl.
*A61H 1/02* (2006.01)
*A63B 23/04* (2006.01)

(52) U.S. Cl.
CPC ..... *A61H 1/024* (2013.01); *A61H 1/0259* (2013.01); *A61H 2201/0192* (2013.01);
(Continued)

(58) Field of Classification Search
CPC ..... A61H 1/02; A61H 1/024; A61H 1/0259; A61H 2201/164; A61H 2201/1664;
(Continued)

(56) References Cited

U.S. PATENT DOCUMENTS 1,984,520 A * 12/1934 Cecil ..... A61H 39/04 602/2
2,093,830 A * 9/1937 Flatley ..... A61H 1/0237 601/29

(Continued)

FOREIGN PATENT DOCUMENTS

CN 204050216 U 12/2014
DE 4208559 C1 7/1993

(Continued)

OTHER PUBLICATIONS

International Search report dated May 19, 2017 in PCT/EP2017/052261.

(Continued)

*Primary Examiner* — Timothy A Stanis
*Assistant Examiner* — Christopher E Miller
(74) *Attorney, Agent, or Firm* — Young Law Firm, P.C.

(57) ABSTRACT

An apparatus for the treatment of arthrofibrosis, has a base having first and second opposing ends and a hole or recess adjacent the first end for enabling connection of the base to a chair to restrict movement of the base relative to the chair. A block is removably attached to the base and is movable between the first and second ends for abutting the toes of a foot of a user of the apparatus placed between the block and the hole or recess. The block is slidable along a guide on the base for enabling adjustment of the block between the first and second ends of the base. A clamp clamps the block in position on the base.

7 Claims, 5 Drawing Sheets

(52) U.S. Cl.
CPC ..... *A61H 2201/1642* (2013.01); *A61H 2201/1664* (2013.01); *A61H 2203/0431* (2013.01)

(58) Field of Classification Search
CPC ..... A63B 21/4045; A63B 22/203; A63B 23/0417; A63B 23/10; A63B 23/03508; A63B 23/0405
See application file for complete search history.

(56) References Cited

U.S. PATENT DOCUMENTS 2,397,054 A * 3/1946 Segalla ..... A63B 21/023 482/125
2,542,074 A 2/1951 Bierman
2,720,396 A * 10/1955 Pfaus ..... A63B 23/0417 482/130
2,826,192 A * 3/1958 Mangas ..... A61H 1/0259 601/26
2,969,060 A 1/1961 Swanda et al.
3,066,322 A * 12/1962 Georget ..... A61G 7/0755 5/651
4,229,001 A * 10/1980 Roman ..... A63B 21/012 482/114
4,463,947 A * 8/1984 Kloenne ..... A61H 1/024 482/139
4,619,454 A * 10/1986 Walton ..... A63B 22/203 482/128
4,645,201 A * 2/1987 Evans ..... A63B 22/0012 482/51
4,948,121 A * 8/1990 Haaheim ..... A63B 22/0012 434/253
4,960,276 A * 10/1990 Feuer ..... A63B 21/157 482/4
4,979,731 A * 12/1990 Hermelin ..... A63B 22/001 482/51
5,145,481 A * 9/1992 Friedebach ..... A63B 21/015 482/118
5,279,530 A * 1/1994 Hess ..... A63B 21/0552 482/121
5,279,531 A * 1/1994 Jen-Huey ..... A63B 23/0417 482/51
5,281,001 A * 1/1994 Bergsten ..... A47B 21/0371 248/118
5,339,542 A 8/1994 Kim
5,499,958 A * 3/1996 Hess ..... A63B 21/0552 482/123
5,807,212 A * 9/1998 Nelson ..... A47C 7/62 482/60
6,010,434 A * 1/2000 Hodges ..... A63B 21/0552 482/129
6,042,523 A * 3/2000 Graham ..... A63B 21/0552 482/121
6,234,173 B1 * 5/2001 Hajianpour ..... A61G 13/12 128/869
6,821,231 B1 * 11/2004 Hall ..... A63B 23/0429 482/131
7,036,169 B2 * 5/2006 Marshall ..... A61B 6/0421 378/208
7,137,936 B1 * 11/2006 Shaw ..... A63B 21/025 482/127
8,740,757 B1 6/2014 Fiorito
9,283,428 B1 * 3/2016 Esrick ..... A63B 21/00069
9,440,105 B1 * 9/2016 Lee ..... A63B 23/04
9,526,945 B1 * 12/2016 Edmondson ..... A63B 23/0494
9,616,283 B1 * 4/2017 Heineck ..... A61H 1/024
D802,687 S * 11/2017 Diallo ..... D21/668
2001/0036885 A1 * 11/2001 Castellot, Jr. ..... A63B 21/4015 482/79
2002/0068665 A1 * 6/2002 Tran ..... A63B 23/0482 482/79
2003/0120186 A1 * 6/2003 Branch ..... A61H 1/0259 601/34
2006/0040799 A1 * 2/2006 Pompile ..... A63B 21/4047 482/92
2007/0087922 A1 * 4/2007 Rizzo ..... A63B 21/00185 482/135
2009/0137369 A1 * 5/2009 Branch ..... A61H 1/0259 482/112
2009/0163837 A1 6/2009 Sanger et al.
2010/0285924 A1 * 11/2010 Shauli ..... A63B 23/03541 482/8
2011/0105277 A1 * 5/2011 Shauli ..... A63B 23/0355 482/4
2011/0294633 A1 * 12/2011 Esrick ..... A63B 21/0552 482/139
2012/0065030 A1 * 3/2012 Sandvig ..... A63B 22/203 482/79
2012/0077653 A1 * 3/2012 Dedov ..... A63B 22/203 482/139
2012/0190511 A1 * 7/2012 Sprague ..... A63B 23/03525 482/91
2012/0190515 A1 * 7/2012 Barry ..... A63B 21/055 482/139
2012/0232438 A1 * 9/2012 Cataldi ..... A63B 21/4045 601/5
2012/0244998 A1 * 9/2012 Rao ..... A63B 22/20 482/70
2013/0237393 A1 * 9/2013 Kerdjoudj ..... A63B 22/203 482/122
2013/0245510 A1 * 9/2013 Zaborowski ..... A63B 23/03541 601/33
2014/0031175 A1 * 1/2014 Peralo ..... A63B 23/0244 482/66
2014/0094721 A1 * 4/2014 Diallo ..... A63B 21/0058 601/5
2014/0221881 A1 * 8/2014 Schlauder ..... A63B 21/00069 601/23
2014/0243161 A1 * 8/2014 Hensel ..... A63B 21/068 482/68
2014/0274605 A1 * 9/2014 McCanney ..... A63B 23/16 482/129
2017/0128775 A1 * 5/2017 Santos ..... A63B 21/00069

FOREIGN PATENT DOCUMENTS

DE 19725973 A1 12/1998
FR 2795307 A1 12/2000
WO 2011119902 A1 9/2011

OTHER PUBLICATIONS

Written Opinion of the International Searching Authority dated May 19, 2017 in PCT/EP2017/052261.
Patent Act 1977: Search Report under Section 17, GB Intellectual Property Office dated May 20, 2017 in application GB1600742.9.

* cited by examiner

ORTHOPAEDIC APPARATUS FOR TREATMENT OF ARTHROFIBROSIS

TECHNICAL FIELD

The present invention relates to the treatment of arthrofibrosis.

BACKGROUND ART

Arthrofibrosis of the knee most commonly occurs following the total replacement of a knee, fracture of the proximal tibia or distal femur. The process of arthrofibrosis begins when the traumatic stimulus of an injury or surgery leads the knee to form extensive, internal scar tissue. This is followed by shrinkage and tightening of the knee's joint capsule. Sometimes nearby tendons outside of the joint stiffen up. This internal and external tightening process may continue to the point where motion between the femur and tibia is severely restricted. Affected patients may permanently lose the ability to fully straighten and/or bend their knee. This lack of crucial knee flexion in most cases will lead to expensive corrective surgery and a traumatic procedure causing additional pain and possible complications to the patient, with significant cost to the NHS.

DISCLOSURE OF INVENTION

The present invention seeks to provide an improved orthopaedic apparatus for the treatment of arthrofibrosis.

Accordingly, the present invention provides an orthopaedic apparatus for the treatment of arthrofibrosis of the knee, comprising: a base for supporting a foot of a user of the apparatus, said base having first and second opposing ends; first connection means adjacent said first end for enabling connection of said base to a leg of a chair thereby to restrict movement of the base relative to said chair; abutment means movable between said first and second ends on said base; said abutment means being adapted for abutting the toes of said foot of said user thereby to restrict movement of said foot towards said first end of said base when placed between said abutment means and said second end of said base; and clamping means engageable with said abutment means for clamping said abutment means in position on said base thereby to enable a knee of said user seated on the chair to be maintained in flexion.

Preferably, the orthopaedic apparatus further comprising guide means for guiding movement of said abutment means between said first and second ends of said base.

Advantageously, said guide means is adapted to guide said abutment means in a substantially linear path between said first and second ends of said base.

Preferably, said clamping means is engageable with both said abutment means and said guide means for clamping said abutment means in position on said base.

In a preferred embodiment, said guide means comprises at least one groove in said base and said clamping means engages in said groove for releasably clamping said abutment means in position on said base.

In a further preferred form of the invention said clamping means comprises first and second interengageable parts (30, 32) movable relative to one another between first and second positions; and wherein in said first position of said first and second parts said clamping means is engageable with said abutment means and said guide means thereby to clamp said abutment means in position and in said second position said clamping means allows movement of said abutment means along said guide means.

Advantageously, said guide means comprises at least one elongate through-slot in the base; said first interengageable part is a locking member extending through said abutment means; said second interengageable part is a cooperating member engaged in said slot; said cooperating member and said slot have cooperating engagement surfaces; and wherein in said first position of said first and second interengageable parts said cooperating engagement surfaces engage thereby to clamp said abutment means in position and in said second position said cooperating surfaces are disengaged to allow movement of said abutment means along said guide means.

In a further preferred form of the invention said guide means comprises at least one rail on said base and said clamping means engages said rail for releasably clamping said abutment means in position on said base.

Preferably, said clamping means comprises first and second interengageable parts (30, 32) movable relative to one another between first and second positions; and wherein in said first position of said first and second parts said clamping means is engageable with said abutment means and said rail thereby to clamp said abutment means in position and in said second position said clamping means allows movement of said abutment means along said guide means.

Advantageously, said second interengageable part and said rail have cooperating engagement surfaces; and wherein in said first position of said first and second interengageable parts said cooperating surfaces engage thereby to clamp said abutment means in position and in said second position said cooperating surfaces are disengaged to allow movement of said abutment means along said guide means.

Preferably, said first connection means is formed by a recess in said base for receiving said chair leg.

Advantageously, said first connection means is formed by a through-hole in said base for receiving said chair leg.

In a further preferred form of the invention the orthopaedic apparatus further comprises second connection means for connecting said base to a second leg of said chair, thereby further to restrict movement of said base relative to said chair in use.

Preferably, said second connection means comprises first and second end portions, said first end portion being connected at or adjacent said first end of said base and said second end portion being adapted for connection to said second leg of said chair.

Advantageously, said second connection means comprises an elongate, flexible member with adjustment means for applying tension to said member in use.

BRIEF DESCRIPTION OF THE DRAWINGS

The present invention is further described, hereinafter, by way of example only, with referenced to the accompanying drawings, in which.

PREFERRED EMBODIMENTS OF THE INVENTION

Figure 3:
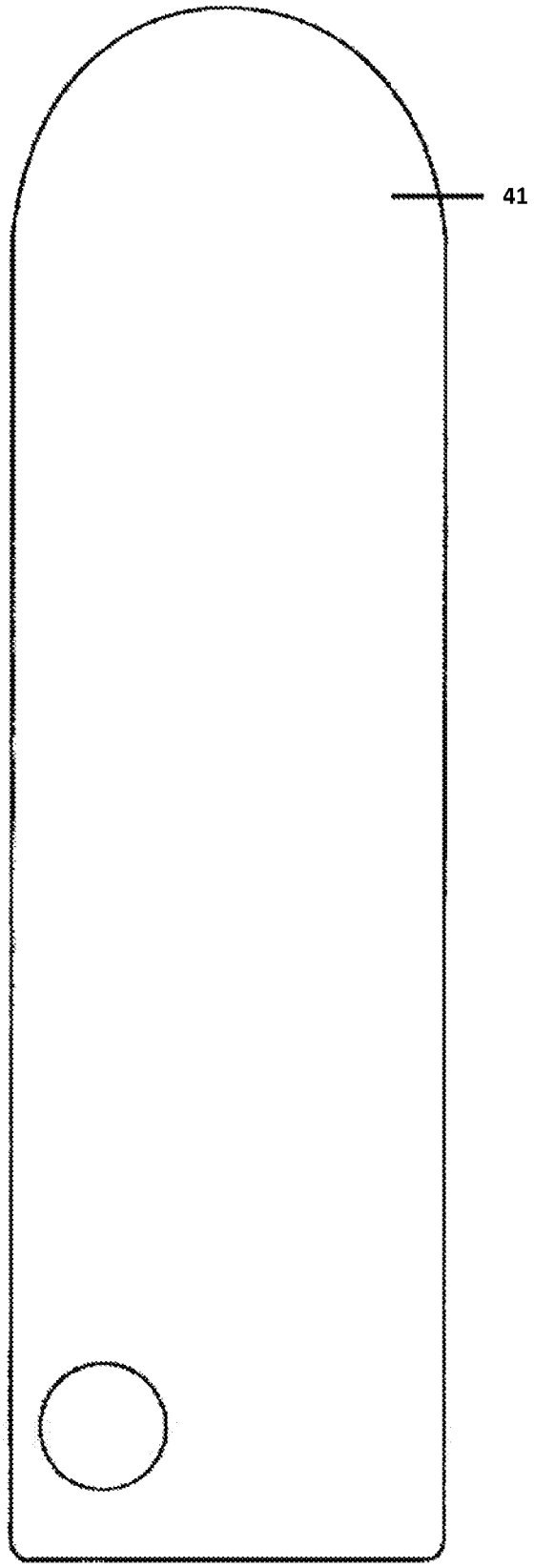
FIG. 3 is a view of a mat formed of an anti-slip material for use with the apparatus of FIG. 1.

FIGS. 1, 2, 4 and 6 of the drawings show a preferred form of apparatus 10 for the treatment of arthrofibrosis. The apparatus has a base 12 which is shown as generally elongate although it will be appreciated that any suitable shape may be used. The base rests on an optional mat 41 (FIG. 3) of anti-slip material which assists in preventing movement of the apparatus in use. The base 12 has guide means 14 which are ideally formed by two preferably rectilinear, parallel grooves extending between front and rear end portions 16, 18 of the base 12. An abutment means 20 is provided for abutment with the toes of a user of the apparatus. The preferred form of abutment means 20 is a simple block, here curved in shape for easier fit with the user's toes, although it will be appreciated that any suitable shape may be used. The block may simply sit on the base 12 over the grooves 14 or have lugs or projections (not shown) which sit or engage in the grooves for easier guided movement of the block along the grooves.

The abutment means 20 is provided with clamping means 22 to clamp the abutment means 20 in position on the grooves and prevent movement when the clamping means 22 is engaged.

In the preferred embodiment a respective clamping means is provided for each groove 14 although it will be appreciated that only one need be used. Each clamping means 22 here has a locking member 30 which is engaged through a respective through-hole 38 in the block 20 with a cooperating member 32 which sits in a respective groove 14.

Each locking member 30 is preferably in the form of a screw threaded member such as an Allen screw whilst each cooperating member 32 may simply be a screw-threaded member such as a nut which sits in the groove 14. The or each groove 14 is rebated in the underside 42 of the base 12 to leave shoulders 44 (FIG. 4) against which the cooperating member 32 abuts.

Figure 4:
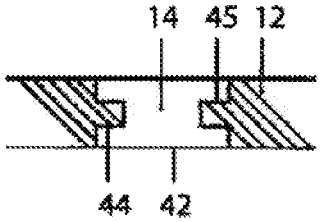
FIG. 4 is a cross section of the apparatus of FIG. 2 on the line 4-4.
Figure 6:
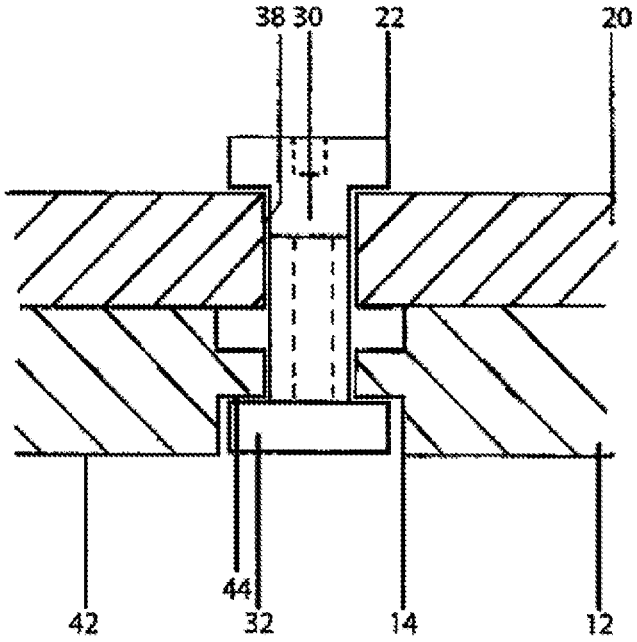
FIG. 6 is a partial cross section through the apparatus of FIG. 1 showing the manner in which the abutment means is clamped.

The cooperating member 32 has a dimension large enough to prevent it being pulled upwardly through the groove 14 but small enough for the member 32 to sit in the rebate formed by the shoulders 44. As can be seen in FIGS. 4 and 6 the shoulders 44 provide cooperating surfaces which engage with cooperating surfaces on the member 32. The locking member 30 engages in the cooperating member 32 and can be tightened or loosened to engage or disengage the cooperating member 32 and shoulder 44 surfaces against one another to allow or restrict movement of the block 20 on the base.

When the locking member 30 is loosened the block 20 can be moved along the grooves 14 to a position best suited to the person using the apparatus.

Although the guide means is shown in the drawing as comprising two grooves 14, it will be appreciated that the number of grooves or rails may be varied from one or three or more and can be of any suitable cross-section for engagement of the clamping means.

Figure 1:
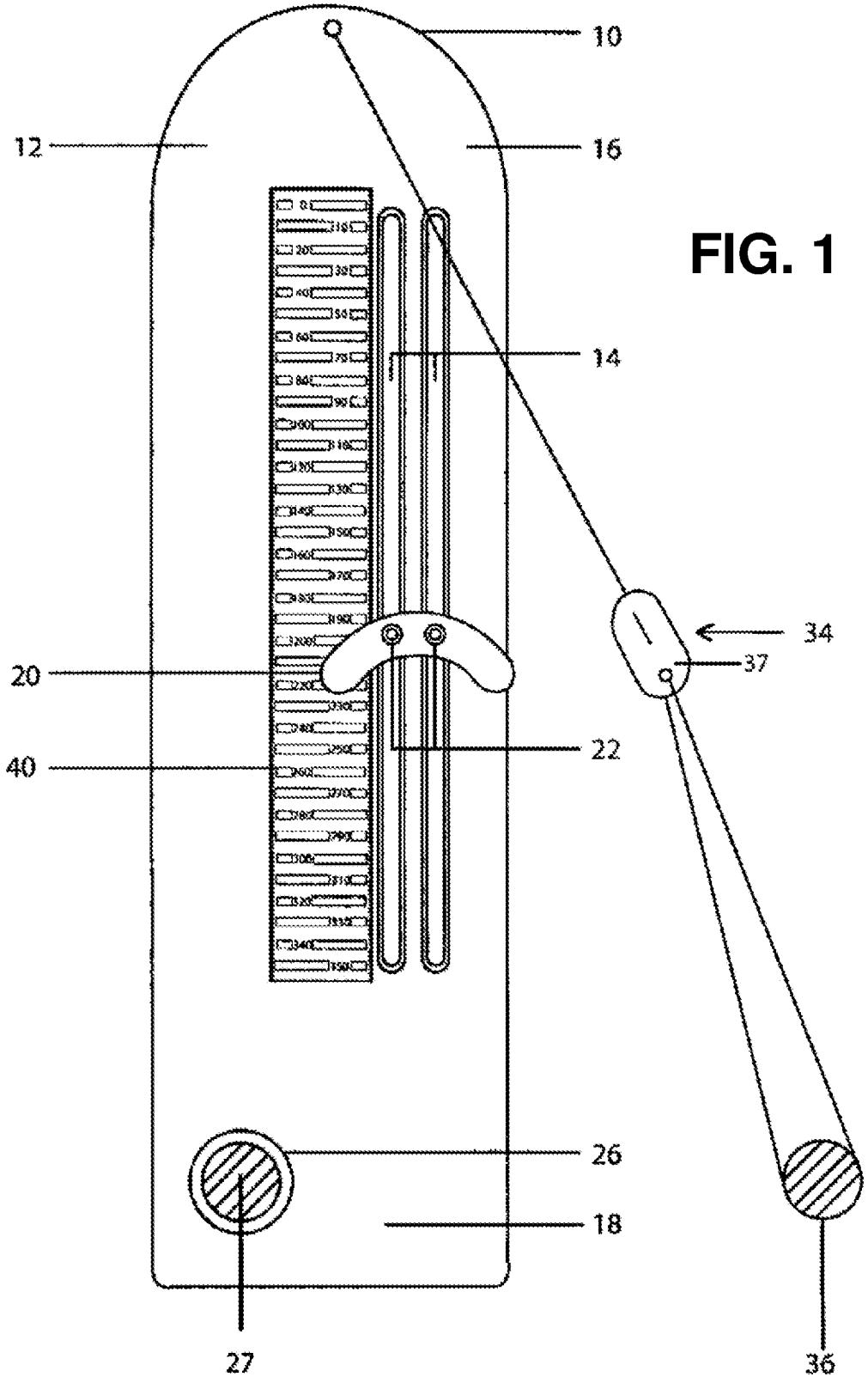
FIG. 1 is a plan view from above of a preferred embodiment of apparatus according to the present invention attached to a chair leg.
Figure 2:
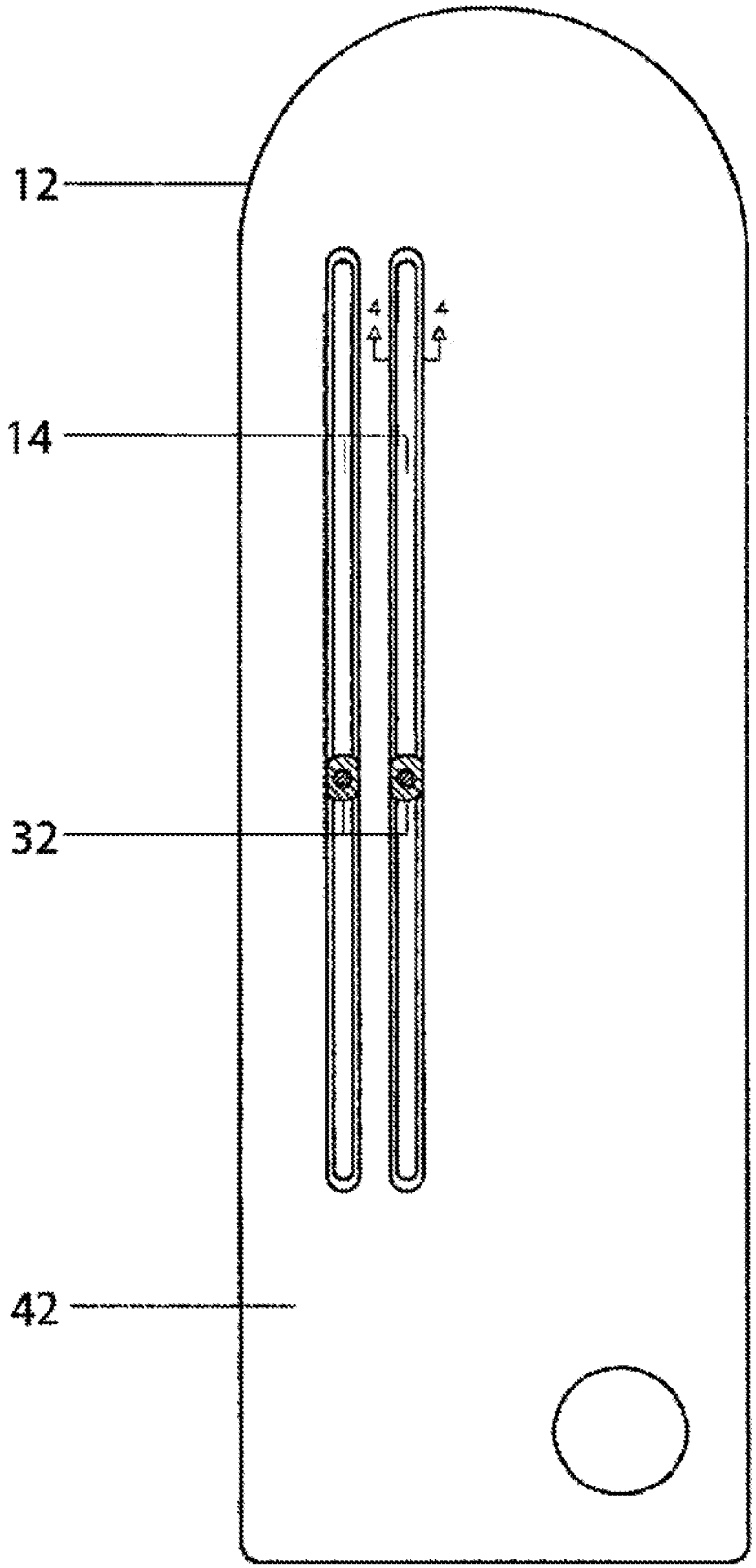
FIG. 2 is a view of the apparatus of FIG. 1 from below.

The base 12 also has first connection means 26 for enabling the apparatus to be loosely secured to a leg 27 of a chair or other furniture on which the user can sit. In this embodiment the connection means is in the form of a hole, preferably a through-hole, in which the chair leg sits. A second optional connection means 34 also enables the front end 16 of the base 12 to be attached to a second leg 36 of the chair. This is preferably in the form of a tension cord (which may be elasticated) used to connect the base 12, preferably at or adjacent its end region 16 to the second chair leg as shown in FIG. 1. The tension of the cord may be adjusted by a simple cord stopper 37.

The anti-slip mat 41 (FIG. 3) may also be provided under the base 12 if required.

In use, the user simply attaches the apparatus to the chair leg 27, sits in the chair, places his foot (the left foot for the arrangement of the apparatus as shown in the drawings) against the block 20 and then slides his bottom forward towards the edge of the chair seat, pushing his knee into further flexion. The forces on the apparatus are balanced by the user's weight with the friction mat 41 and the tension cord used where additional assistant is required to prevent movement of the apparatus in use. Ideally the user should use the same chair to perform the exercises (preferably a dining/kitchen chair with arms) so that he can receive more accurate feedback on his progress.

The hole 26 in the base in which the chair leg sits connects the chair and the user and prevents any backward sliding of the chair. The tension cord is attached to the opposite chair front leg and together with the anti-slip mat assists in preventing the baseboard sliding sideways. During the stretch the femoral condyle and the contact area moves anterior on the tibia and the joint capsule and surrounding soft tissues are stretched (high intensity stretch at end range of available movement). As tissues are stretched an increased range of movement (ROM) is achieved allowing the block 20 then to be moved into more flexion as desired by the user when the above process is repeated. Users are in complete control of their stretch and can work to their optimum pain threshold. They can mimic the high intensity stretching provided by their physiotherapist daily themselves in their own home. The apparatus provides users with instant results and users can record their progress visually through a drawn scale 40 next to the grooves on the apparatus as their knee flexion improves. This brings huge motivation to a group of users who really need it.

Users can work independently on their knee ROM daily helping to speed recovery and improve final outcomes. The position of the block 20 is adjustable by sliding along the groove or grooves 14 and is easily clamped into position to place the foot and subsequently the knee into the desired amount of flexion.

The apparatus is ideal for use both in hospital and at home, greatly increasing the usage of the apparatus, and has a number of significant advantages over existing treatments for arthrofibrosis. It is of simple construction and easy to use and is relatively inexpensive to manufacture.

The apparatus may allow users to begin treatment within a few days following their operation. It allows the user to exercise on a regular basis and encourages self-motivation in patients since the patient controls and monitors his own progress.

The simple and effective anchorage system allows the apparatus to be used with a household chair, it is easy to assemble to treat either the left or the right knee and can also be used by patients who have a below knee external fixator.

Figure 5:
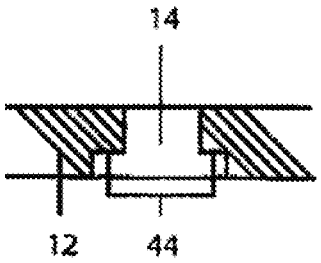
FIG. 5 is a cross section similar to that of FIG. 4 showing a modified embodiment of the apparatus of FIG. 1.

As can be seen in FIGS. 1 and 4, the grooves 14 are provided with rebates in the upper and lower surfaces of the board 12 to provide shoulders 44, 45 (FIG. 4). This allows the board 12 to be inverted to facilitate the use of the apparatus on either the left or right knee. To switch legs, the abutment member is detached from the board 12 which is inverted and the abutment member reattached on the opposite side of the board, which is now the upper side. It will of course be appreciated that the rebates may be provided only in the underside of the grooves 14, as shown in FIG. 5, In a further embodiment of the invention (not shown in the drawings), additional guides can be provided on the left hand side of the board parallel to the guides 14 shown in FIG. 1. The abutment member is then detached from the guides 14 and reconnected to the parallel guides. For this option there would also be an additional connection means (not shown), preferably in the form of a hole, opposite the existing hole 26 shown in FIG. 1. This facilitates use of the apparatus for the left or right knee without having to invert the board. In this case, the grooves 14 may be shaped as in FIG. 5, with the rebates 44 only on the underside of the grooves.

Figure 7:
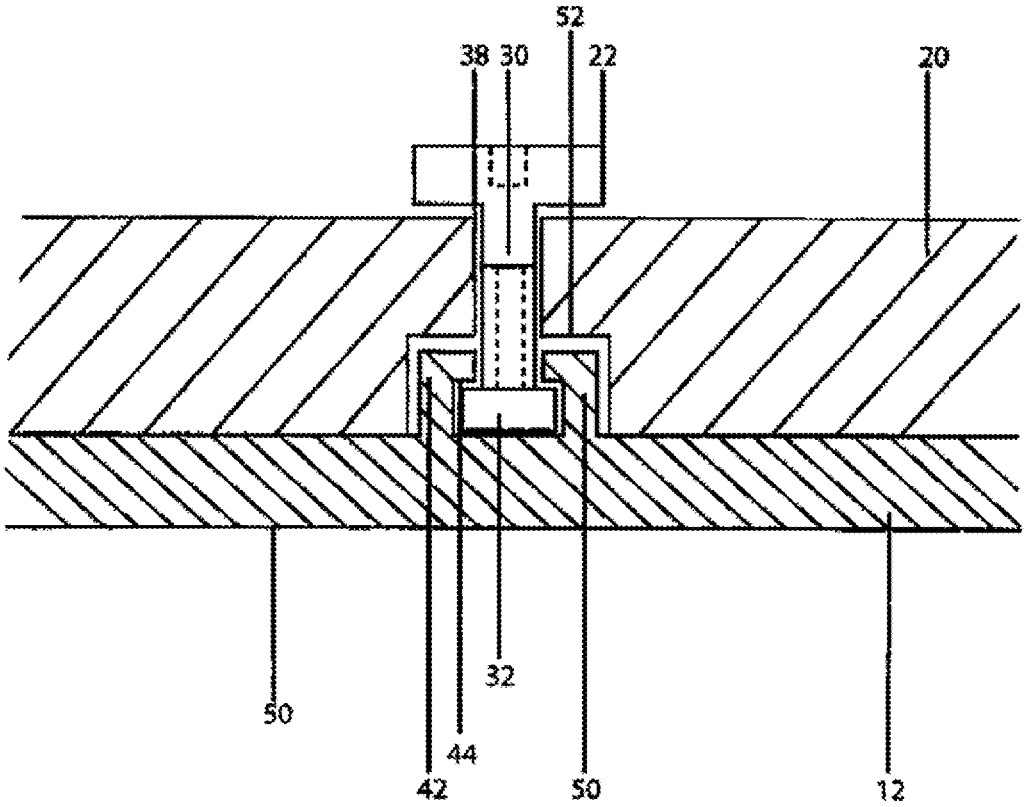
FIG. 7 is a view similar to that of FIG. 6 showing a further modified form of the invention.

FIG. 7 shows a modified guide means 14 which is formed by a rail or rails 50 with the or each rail being of inverted L-shape (or of T-shape) cross section and the block 20 having a respective slot 52 contoured to engage with and ride on the or each rail 50.

Figure 8:
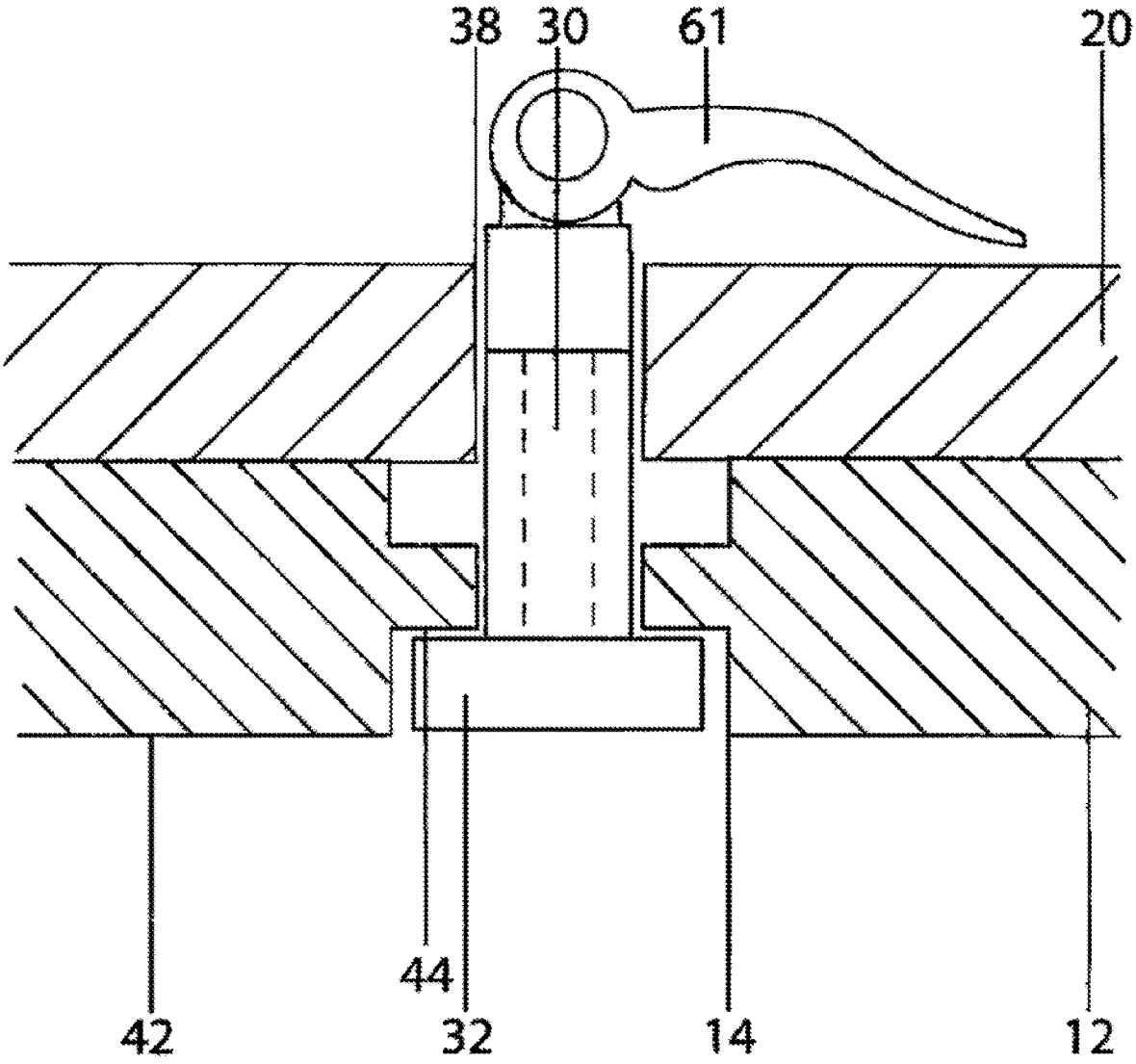
FIG. 8 is a view similar to that of FIG. 6 showing a still further modified form of the invention

FIG. 8 is a view, similar to that of FIGS. 4 to 7, showing a further manner of securing the abutment means 20 to the base 12. The or each clamping means 22 is in the form of an over centre clamp which has a handle 61 engaged with a bolt or rod 30 which in turn engages through the respective through-hole 38 in the block 20 and into the respective groove 14. Alternatively, the handle 61 may be in the form of a butterfly nut or similar which is engaged with the bolt or rod 30 on a screw thread and can be screwed up or down to loosen or tighten the clamp.

Whilst several embodiments of the invention have been described here, it will be appreciated that the features of the embodiments are interchangeable and the features of one embodiment may equally be applied to any other embodiment.

Whilst the invention is described as being suitable for the treatment of arthrofibrosis it will be appreciated that it can be applied to the treatment of stiffness or contracture of the knee.

The invention claimed is:

1. An orthopedic apparatus for the treatment of arthrofibrosis of a knee of a user seated on a chair, the apparatus comprising:

a base configured to support a foot of a user of the apparatus, the base having upper and lower surfaces and first and second opposing ends and comprising a first connector adjacent the second end, the first connector defining one of a recess in the upper surface and a through hole through the upper and lower surfaces and being configured and positioned to enable engagement of the base to a leg of the chair in the first connector to restrict movement of the base relative to the chair, the base further comprising a groove extending at last partway between the first and second ends, the groove comprising a rebate in the upper and lower surfaces along a length thereof that defines an upper surface shoulder along the groove in the upper surface and a lower surface shoulder along the groove in the lower surface;

a cooperating member configured to engage with the groove and comprising a cooperating surface configured to selectively face and engage with the upper or lower surface shoulder, the cooperating member being movable along the groove between the first and second ends on the base;

an abutment coupled to the cooperating member and configured to be selectively positioned on the upper or lower surface of the base, depending upon which foot of the user is to be engaged in the abutment, and configured to be movable with the cooperating member between the first and second ends on the base, the abutment defining a shape having a middle portion and first and second free ends, the middle portion being closer to the first end of the base than the first and second free ends, the shape of the abutment being configured to receive and abut toes of the foot of the user sitting on the chair and to prevent movement of the foot towards the first end of the base when placed between the abutment and the second end of the base; and a clamp connecting the cooperating member and the abutment and configured with the cooperating member to selectively clamp the abutment on the upper or lower surface in a selected clamped position along the groove on the base away from the first connector to maintain the foot of the user flat selectively against the upper or lower surface of the base and in position against the abutment and to enable the knee of the user seated on the chair to be maintained in flexion.

2. The orthopedic apparatus of claim 1, wherein the abutment, cooperating member and the clamp are configured to slide in a substantially linear path along the groove between the first and second ends of the base and to lock in place at a selected position on the base between the first and second ends thereof.

3. The orthopedic apparatus of claim 1, wherein, in a first configuration, the clamp is engaged with the cooperating member to clamp the abutment in position, and wherein in a second position, the clamp is at least partially disengaged with the cooperating member to allow movement of the abutment along the groove.

4. The orthopedic apparatus of claim 1, wherein the base further comprises at least one rail and wherein the clamp is configured to engage the rail to releasably clamp the abutment in position on the base.

5. The orthopedic apparatus of claim 1, further comprising a second connector configured to connect the base to a second leg of the chair to restrict movement of the base relative to the chair in use.

6. The orthopedic apparatus of claim 5, wherein the second connector comprises first and second end portions, the first end portion being connected at or adjacent the first end of the base and the second end portion being configured to connect to the second leg of the chair.

7. The orthopedic apparatus of claim 5, wherein the second connector comprises an elongate, flexible member having an adjustment device configured to apply tension to the elongate, flexible member in use.

* * * * *